US008087891B1

(12) United States Patent
Liang

(10) Patent No.: US 8,087,891 B1
(45) Date of Patent: Jan. 3, 2012

(54) TURBINE BLADE WITH TIP REGION COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1016 days.

(21) Appl. No.: 12/018,360

(22) Filed: Jan. 23, 2008

(51) Int. Cl.
*F01D 5/18* (2006.01)

(52) U.S. Cl. ..... 416/97 R; 416/1

(58) Field of Classification Search ..... 416/1, 92, 416/97 R; 415/115
See application file for complete search history.

(56) References Cited

U.S. PATENT DOCUMENTS 4,767,268 A * 8/1988 Auxier et al. ..... 416/97 R
5,660,523 A * 8/1997 Lee ..... 416/97 R
6,595,748 B2 * 7/2003 Flodman et al. ..... 416/97 R
7,186,082 B2 * 3/2007 Mongillo et al. ..... 416/1
* cited by examiner

*Primary Examiner* — Ninh H Nguyen
(74) *Attorney, Agent, or Firm* — John Ryznic

(57) ABSTRACT

A turbine blade with a tip region cooling circuit in which cooling air from a serpentine flow circuit in the main airfoil body passes into the tip cooling circuit and around the suction side and pressure side walls to better cool the airfoil and tip with low cooling air flow. A 5-pass serpentine circuit with a first leg is located along the leading edge and is connected directly to a showerhead arrangement to provide film cooling for the leading edge. The 5-pass serpentine circuit, discharges cooling air from the last leg into impingement holes and exit slots spaced along the trailing edge. The remaining cooling air from the 5-pass serpentine flows from the last leg and into the 2-pass serpentine flow circuit located within the tip section. The cooling air flows along the suction side first, makes a turn around the leading edge in the tip, and then flows along the suction side passage where a row of film cooling holes discharges film cooling air onto the pressure side tip surface. The remaining cooling air flows through a trailing edge tip hole and is discharged.

19 Claims, 4 Drawing Sheets

View A-A

View B-B

TURBINE BLADE WITH TIP REGION COOLING

BACKGROUND OF THE INVENTION

1. Field of the Invention

The present invention relates generally to a turbine blade, and more specifically to cooling of the tip region of the turbine blade.

2. Description of the Related Art Including Information Disclosed Under 37 CFR 1.97 and 1.98

In a gas turbine engine, a hot gas flow is developed in the combustor from the burning of a fuel with compressed air from the compressor and then passed through a multiple staged turbine to produce mechanical power. In an aero engine, the mechanical power drives the rotor shaft that is connected to a bypass fan. In an industrial gas turbine engine, the rotor shaft is connected to an electric generator that will produce electrical power. In both engines, the engine efficiency can be increased by passing a higher temperature gas into the turbine. However, the turbine inlet temperature is limited to the material properties of the first stage turbine airfoils, these airfoils being the stator vanes and the rotor blades.

Complex internal airfoil cooling passages have been proposed to provide high levels of airfoil cooling using a minimal amount of cooling air. Higher turbine inlet temperatures are obtainable by providing improved airfoil cooling. Also, since the compressed air used to cool, these airfoils is taken from the compressor, the use of a minimal amount of compressor bleed off air for the airfoil cooling will also increase the engine efficiency.

Airfoil cooling is also important in increasing the life of the airfoils. Hot spots can occur on sections of the airfoils that are not adequately cooled. These hot spots can cause oxidation that will lead to shortened life for the airfoil. Blade tips are especially subject to hot spots since it is nearly impossible to total eliminate the gap between the rotating blade tip and the stationary shroud that forms the gap. Without any gas, blade tip rubbing will occur which leads to other problems. Because of the presence of the tip gap, the hot gas can flow through the gap and expose the blade tip surface to the extreme high temperatures of the gas flow. Therefore, adequate blade tip cooling is also required to reduce hot gas flow leakage and to control metal temperature in order to increase part life.

Airfoils surfaces exposed to the high temperature gas flow are typically coated with a thermal barrier coating or TBC in order to allow for even higher temperatures. As the TBC technology improves, more industrial gas turbine (IGT) blades are applied with a thicker or low conductivity TBC. Cooling flow demand has been gradually reduced. As a result, there is not sufficient cooling flow for the design to split the total cooling flow into two or three flow circuits and utilize the forward flowing serpentine cooling design. Serpentine flow cooling circuits provide higher cooling capabilities than several straight channels in the airfoil because the overall cooling passage length is increased due to the looping of the circuit up and down the airfoil. Cooling flow for the blade leading and trailing edges has to be combined with the mid-chord flow circuit to form a single 5-pass serpentine flow circuit. However, for the forward 5-pass serpentine flow circuit with total blade cooling flow back flow margin (BFM) may become a design issue.

FIG. 1 shows a prior art cross section view of a turbine blade with a 5-pass aft flowing serpentine cooling circuit for a first stage blade. in this cooling circuit, the tip section film cooling is achieved by bleed off cooling air, from the serpentine tip turns. Cooling air bleed off from the 5-pass serpentine flow circuit thus reduces the cooling performance for the serpentine flow circuit. FIG. 2 shows a prior, art first stage turbine blade that uses the cooling circuit of FIG. 1, and FIG. 3 shows a diagram view of the FIG. 1 serpentine flow cooling circuit.

BRIEF SUMMARY OF THE INVENTION

It is an object of the present invention to provide for a turbine blade with enhanced tip section cooling for a relatively high temperature turbine blade cooling design with a TBC and a low cooling flow.

Another object of the present invention to provide for a turbine blade in which the tip section cooling air is used to cool the airfoil main body first in order to fully utilize the cooling air.

The turbine blade includes an aft flowing 5-pass serpentine flow cooling circuit in which the first leg is located adjacent to the leading edge and supplies cooling air to a showerhead arrangement. The last leg, of the serpentine is connected to a dual pass tip region cooling circuit that is formed in the blade tip and flows firstly along the suction side of the tip and secondly along the pressure side. Film cooling holes discharge cooling air from the pressure side pass of the dual tip region cooling circuit, and the remaining cooling air is discharged out through the trailing edge region in an exit hole. The last leg of the serpentine circuit also connects to a row of exit holes spaced along the trailing edge region to discharge some of the serpentine flow through these exit holes. The second and fourth legs of the serpentine circuit also discharge film cooling air through holes located on the pressure side and/or the suction side of the airfoil.

DETAILED DESCRIPTION OF THE INVENTION

Figure 4:
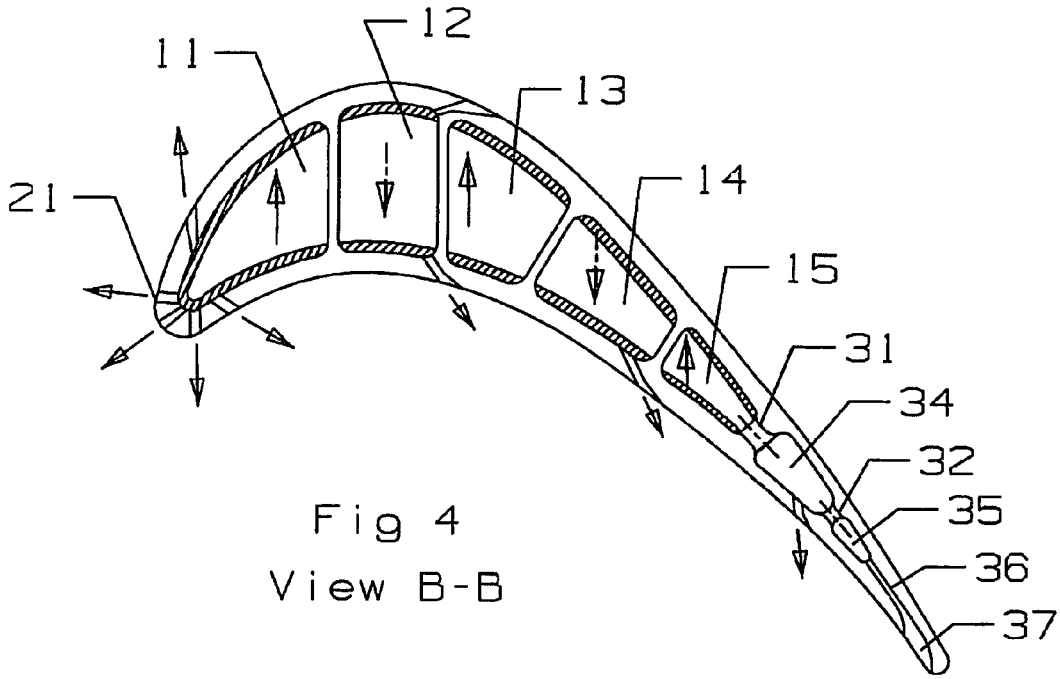
FIG. 4 shows a cross section top view of the 5-pass aft flowing serpentine flow cooling circuit of the present invention.
Figure 5:
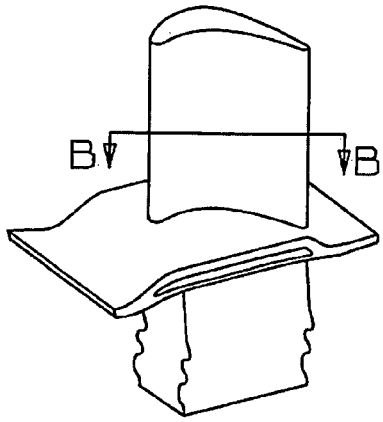
FIG. 5 shows a first stage turbine blade with a line indicating the view from FIG. 4.

The present invention is a turbine blade with a serpentine flow cooling circuit that is used in a blade that is exposed to relatively high temperature and required a relatively low cooling flow. FIG. 4 shows a cross section of the 5-pass serpentine flow cooling circuit used in the airfoil portion of the blade. The 5-pass serpentine circuit includes a first leg 11 located adjacent to the leading edge; a second leg 12, a third leg 13, a fourth leg 14 and a fifth leg 15 located adjacent to the trailing edge region. In the present invention, the first leg 11 of the serpentine circuit is directly connected to the showerhead film cooling holes 21 located along the leading edge of the airfoil.

Figure 1:
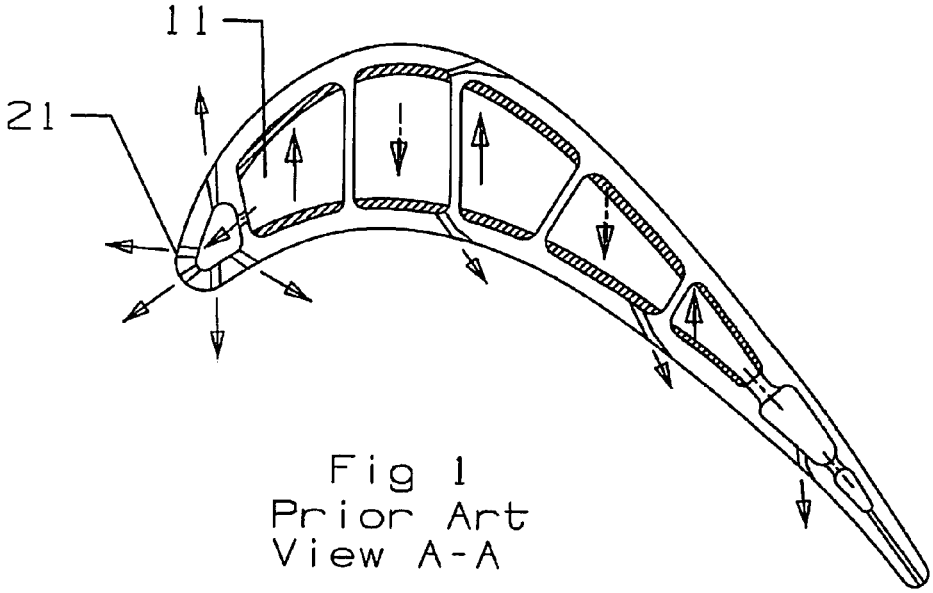
Fig 1 Prior Art
FIG. 1 shows a cross section top view of a 5-pass aft flowing serpentine cooling circuit of the prior art.
Figure 2:
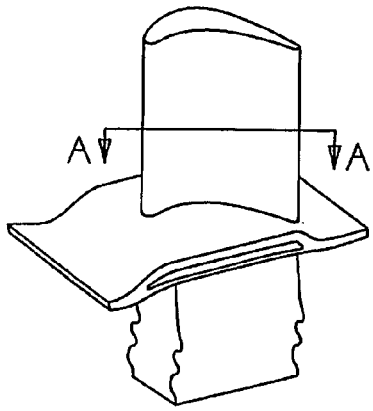
Fig 2 Prior Art
FIG. 2 shows a prior art first stage turbine blade.
Figure 3:
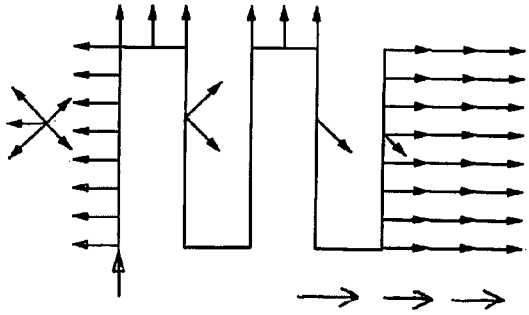
Fig 3 Prior Art
FIG. 3 shows a diagram view of the 5-pass serpentine flow circuit of FIG. 1.

In the prior art circuit of FIG. 1, the first leg flows into a leading edge impingement cavity through metering and impingement holes, and the showerhead film cooling holes are directly connected to the impingement cavity.

The trailing edge region of the blade in FIG. 4 includes a first impingement hole 31 and a second impingement hole 32 with a first impingement cavity 34 and a second impingement cavity 35 connected downstream to the impingement holes. An exit hole 36 with an exit slot 37 connects the impingement holes and cavity into a series of cooling air flow to discharge cooling air from the fifth leg. A row of these impingement holes and impingement cavities extend along the trailing edge region of the airfoil.

Pressure side and suction side gill holes are not used in the cooling circuit of the present invention. The second leg includes a row of pressure side film cooling holes and suction side cooling holes. The fourth leg 14 includes a row of pressure side film cooling holes. The first impingement cavity 34 includes a film cooling hole.

Figure 6:
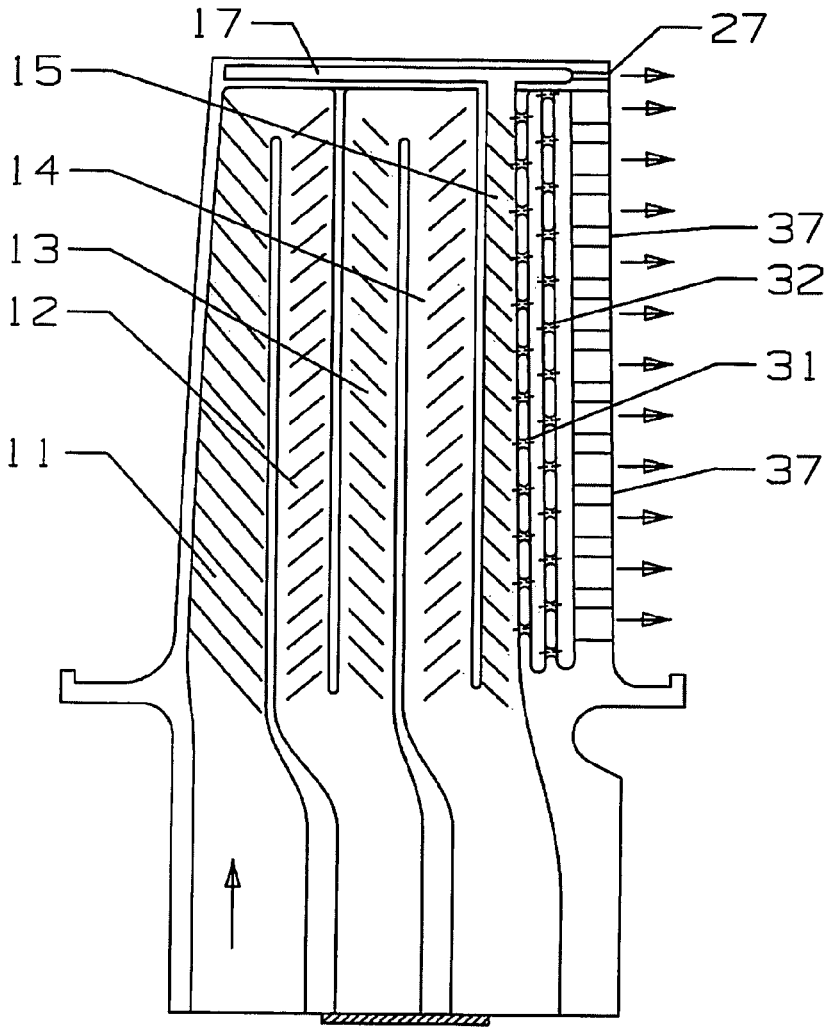
FIG. 6 shows a cross section side view of the serpentine flow cooling circuit of the present invention.

FIG. 6 shows a side view of a cross section through the blade showing the 5-pass serpentine flow cooling circuit of the present invention. the first leg 11 flows upward and along the leading edge of the blade, the second leg flows downward, the third leg flows upward, the fourth leg flows downward, and the fifth leg flows upward toward the tip region. The first and second impingement holes 31 and 32 are shown and offset from each other. The exit slots 37 are shown extending along the trailing edge region of the airfoil.

Figure 8:
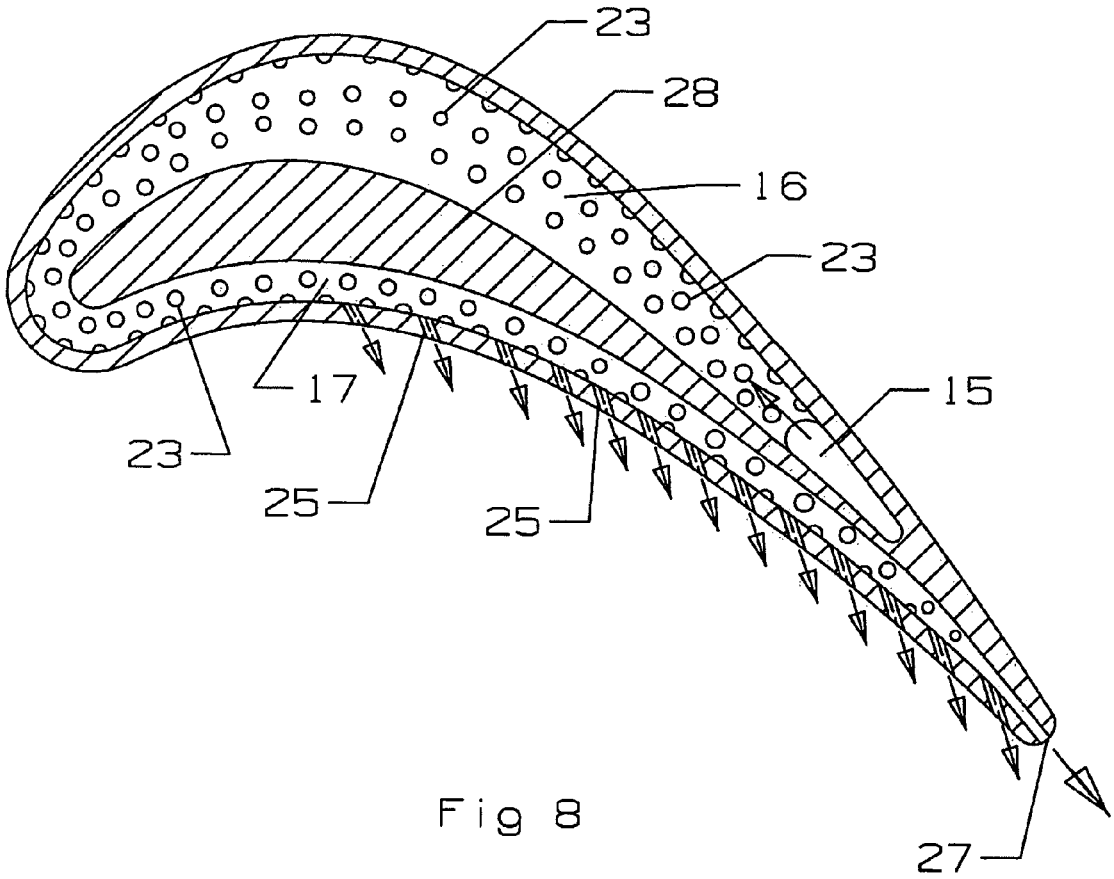
FIG. 8 shows a cross section top view of the blade tip region cooling circuit of the present invention.

FIG. 8 shows the blade tip cooling circuit and includes an opening or hole to connect the last or fifth leg 15 of the 5-pass serpentine flow circuit to the dual or 2-pass serpentine flow circuit of the blade tip. A first leg or suction side leg 16 is formed between the suction side wall and chordwise extending rib or divider 28. The suction side leg 16 extends around the leading edge and turns into the second leg or pressure side leg of the 2-pass serpentine circuit in the tip. Pin fins 23 are spaced along the 2-pass serpentine tip circuit to promote heat transfer coefficient within these legs. Film cooling holes 25 are connected to the pressure side leg and extend along the pressure side blade tip. The pressure side leg continues along to the trailing edge region of the tip and discharges out the tip through a tip hole 27. With width of the legs in the 2-pass serpentine tip circuit can vary depending upon the flow volume and pressure and the cooling requirements.

The showerhead film cooling holes, the tip film cooling holes along the pressure side of the tip and the tip exit hole 27 can all be sized to control the cooling flow and pressure as well as the metal temperature along the airfoil and the tip sections.

Pressurized cooling air is supplied to the first leg 11 of the airfoil 5-pass serpentine circuit and flows upward toward the tip region. Cooling air bleeds off and flows through the showerhead film cooling holes 21 and gills holes located along the leading edge region of the airfoil. The remaining cooling air flow from the first leg 11 flows around the tip turn and then into the second leg 12. From the second leg 12, film cooling air is discharged out through the pressure side and suction side film cooling holes shown in FIG. 4 and that extend along the airfoil in the spanwise direction along the second leg 12. From the second leg 12, the cooling air flows around a root turn and into the third leg 13, then around a second tip turn and into the fourth leg 14, where film cooling air is discharged through a row of pressure side film cooling air spaced along the fourth leg of the airfoil.

Figure 7:
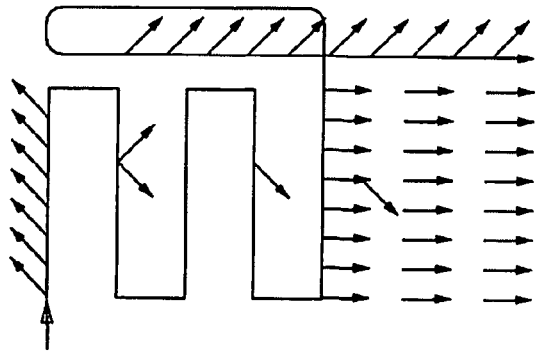
FIG. 7 shows a diagram view of the serpentine flow cooling circuit of the present invention in FIG. 6.

From the fourth leg 14 the cooling air turns at the second root turn and flows up through the fifth and last leg 15 where some of the cooling air is diverted through the first impingement holes 31 and then through the remaining holes and slots positioned along the trailing edge region of the airfoil. The remaining cooling air flow in the fifth leg 15 that is not diverted flows up and into the tip region cooling circuit through the hole and into the suction side leg 16 of the 2-pass serpentine flow tip circuit. The cooling air flows through the suction side leg 16 and around the numerous pin fins 23, around the leading edge of the tip, and then along the pressure side leg 17. Some of the cooling air flow in the pressure side, leg 17 is discharged out through the row of film cooling holes 25 located along the pressure side tip edge of the blade. Pin fins located in the pressure side leg 17 also increase the heat transfer coefficient. The remaining cooling air in the 2-pass serpentine flow circuit flows through the exit hole 27 and out from the tip. FIG. 7 shows a schematic view of this blade airfoil and tip region cooling circuit.

Major design features and advantages of the cooling circuit of the present invention over the prior art circuit are described below.

The cooling circuit of the present invention minimizes the blade BFM (back flow margin) issue. Back flow is when the hot gas flow on the outside of the airfoil flows into the inside of the airfoil through the holes because the interior cooling air pressure is not high enough to prevent this.

In the cooling circuit of the present invention, the total blade cooling air is fed through the airfoil forward section and flows toward the airfoil trailing edge, and thus maximizes the use of cooling pressure potential.

In the cooling circuit of the present invention, higher cooling mass flow through the airfoil main body will yield lower mass average blade metal temperature which results in a higher stress rupture life for the blade.

In the cooling circuit of the present invention, blade total cooling flow is fed through the airfoil pressure side section where the external gas side heat load is low. Since the cooling air temperature is fresh, the cooling air feed system will maximize the use of cooling air potential to achieve a non-film cooling zone for the airfoil. Elimination of leading edge and pressure side and suction side gill holes becomes feasible.

In the cooling circuit of the present invention, tip section cooling is used for the entire blade cooling first prior to the use of tip section cooling. This doubles the use of cooling air and will maximize the blade cooling effect.

In the cooling circuit of the present invention, all the high heat transfer generated by the pin fins and trip strips within the 2-pass chordwise tip serpentine occurs along the blade pressure and suction peripheral as well as the blade top surface, and thus enhancing the blade tip section convective cooling. In addition, the tip turns for the airfoil main body also provides additional tip section cooling. As a result of the cooling circuit, double cooling for the blade tip section is created and yields a better cooling for a blade tip. Film cooling is also incorporated at the aft portion of the tip 2-pass serpentine flow circuit.

In the cooling circuit of the present invention, the aft flowing 5-pass serpentine flow circuit maximizes the use of cooling air and provides a very high overall efficiency for the entire airfoil, especially when the tip section cooling is channeled through the entire 5-pass serpentine flow circuit.

In the cooling circuit of the present invention, the aft flowing serpentine cooling flow circuit for the airfoil main body will maximize the use of cooling to main stream gas side pressure potential. A portion of the air is discharged at the at section of the airfoil where the gas side pressure is low and thus yields a high cooling air to main stream pressure potential to be used for the serpentine channels and maximize the internal cooling performance for the serpentine.

In the cooling circuit of the present invention, the aft flowing main body 5-pass serpentine flow channel yields a lower cooling supply pressure requirement and a lower leakage because of the lower pressure.

I claim the following:

1. A turbine airfoil comprising:

an airfoil portion and a tip section;

an internal cooling passage to provide cooling for the airfoil portion;

the blade tip section including a 2-pass serpentine flow cooling circuit to provide cooling for the tip section, the 2-pass serpentine flow cooling circuit including a pressure side leg and a suction side leg; and, the 2-pass serpentine flow cooling circuit being connected to the internal cooling passage of the airfoil such that cooling air flows from the internal cooling passage and into the 2-pass serpentine flow cooling circuit.

2. The turbine airfoil of claim 1 and further comprising:

The internal cooling passage for the airfoil portion is an aft flowing serpentine flow cooling circuit.

3. The turbine airfoil of claim 2 and further comprising:

The last leg of the aft flowing serpentine flow cooling circuit discharges into the first leg of the 2-pass serpentine flow cooling circuit of the blade tip section.

4. The turbine airfoil of claim 2 and further comprising:

The first leg of the aft flowing serpentine flow cooling circuit is located along the leading edge of the airfoil; and, A showerhead arrangement of film cooling holes is connected directly to the first leg of the aft flowing serpentine flow cooling circuit.

5. The turbine airfoil of claim 2 and further comprising:

A row of impingement holes connected to the last leg of the aft flowing serpentine circuit; and, A row of exit slots extending along the trailing edge region of the airfoil and connected to the impingement holes.

6. The turbine airfoil of claim 2 and further comprising:

The aft flowing serpentine flow cooling circuit is a 5-pass serpentine circuit; and, The second leg is connected to a row of pressure side and suction side film cooling holes.

7. The turbine airfoil of claim 6 and further comprising:

The fourth leg is connected, to a row of pressure side film cooling holes.

8. The turbine airfoil of claim 1 and further comprising:

The first leg of the 2-pass serpentine flow cooling circuit is located along the suction wall side of the tip;

The second leg of the 2-pass serpentine flow cooling circuit is located along the pressure wall side of the tip; and, A tip turn is located at the leading edge of the tip and connects the first leg to the second leg.

9. The turbine airfoil of claim 8 and further comprising:

The pressure side leg is narrow and the suction side leg is wide such that the cooling flow pressure is higher in the pressure side leg than in the suction side leg.

10. The turbine airfoil of claim 9 and further comprising:

The pressure side leg includes a row of film cooling holes extending along the edge of the tip.

11. The turbine airfoil of claim 1 and further comprising:

Pin fins and trip strips are located along the 2-pass serpentine flow cooling circuit.

12. The turbine airfoil of claim 1 and further comprising:

The pressure side leg of the 2-pass serpentine flow cooling circuit includes a row of film cooling holes extending along the edge of the tip.

13. The turbine airfoil of claim 12 and further comprising:

The end of the pressure side leg discharges into a trailing edge tip exit hole.

14. The turbine airfoil of claim 12 and further comprising:

The row of film cooling holes on the pressure side leg extends from near the leading edge region and to the trailing edge of the airfoil tip.

15. The turbine airfoil of claim 2 and further comprising:

The aft flowing serpentine flow cooling circuit is a 5-pass serpentine circuit; and, The tip turns of the serpentine flow circuit is located underneath the tip such that impingement cooling of the tip occurs when the cooling flow turns.

16. A process for cooling a turbine airfoil main body and tip section comprising the steps of:

Convective cooling a leading edge region of the airfoil main body;

Discharging film codling air onto the leading edge;

Passing the remaining cooling air through a serpentine path in the airfoil main body;

Cooling the airfoil trailing edge region with cooling air bled off from the serpentine path;

Passing the remaining serpentine flow cooling air into the tip section;

Passing the cooling air along the suction side of the tip;

Passing the suction side cooling air around the tip leading edge;

Passing the tip leading edge cooling air along the pressure side of the tip; and, Discharging some of the cooling air from the pressure side tip through film cooling holes to cool the pressure side tip.

17. The process for cooling a turbine airfoil main body and tip section of claim 16, and further comprising the step of:

Passing the remaining pressure side tip cooling air out through a tip trailing edge hole to cool the tip trailing edge.

18. The process for cooling a turbine airfoil main body and tip section of claim 16, and further comprising the step of Cooling the underside of the tip with cooling air in the serpentine flow when the flows turns.

19. The process for cooling a turbine airfoil main body and tip section of claim 16, and further comprising the step of:

Disturbing the cooling air flow along the tip cooling paths to enhance the heat transfer coefficient.

* * * * *